US006319437B1

(12) United States Patent
Elsner et al.

(10) Patent No.: US 6,319,437 B1
(45) Date of Patent: Nov. 20, 2001

(54) POWDER INJECTION MOLDING AND INFILTRATION PROCESS

(75) Inventors: Norbert B. Elsner; Stanley Zalkind, both of La Jolla; Ian Sidney R. Clark; Fred Leavitt, both of San Diego, all of CA (US)

(73) Assignee: Hi-Z Technology, Inc., San Diego, CA (US)

( * ) Notice: Subject to any disclaimer, the term of this patent is extended or adjusted under 35 U.S.C. 154(b) by 0 days.

(21) Appl. No.: 09/250,148

(22) Filed: Feb. 16, 1999

Related U.S. Application Data

(63) Continuation-in-part of application No. 09/044,070, filed on Mar. 16, 1998, now abandoned.

(51) Int. Cl.[7] ..... B22F 3/26; B22F 7/06; B29C 45/14

(52) U.S. Cl. ..... 264/44; 264/610; 264/643; 264/645; 419/6; 419/12; 419/27

(58) Field of Search ..... 264/49, 43, 44, 264/59, 643, 629, 628, 610, 645; 428/544, 566, 614, 304.4, 307.3, 312.2, 704; 419/6, 7, 12, 27

(56) References Cited

U.S. PATENT DOCUMENTS 3,929,476 * 12/1975 Kirby, Jr. et al. ..... 75/214
4,297,421 * 10/1981 Turillon et al. ..... 429/225
4,327,156 * 4/1982 Dillon et al. ..... 428/568
4,861,641 * 8/1989 Foster et al. ..... 428/137
5,735,332 * 4/1998 Ritland et al. ..... 164/98
5,944,097 * 8/1999 Gungor et al. ..... 165/185
5,976,205 * 11/1999 Andrews et al. ..... 51/307

* cited by examiner

*Primary Examiner*—John J. Zimmerman
(74) *Attorney, Agent, or Firm*—John R. Ross; John R. Ross, III

(57) ABSTRACT

A powder injection molding and infiltration process. A powder of a skeleton material having a relatively high melting point is mixed with a composite binder to form a mold mixture. The composite binder is comprised of at least two binder materials. The mold mixture is molded into a desired shape in a mold device to produce a molded part. The composite binder is then removed to produce voids in the molded part and the voids are filled by infiltrating an infiltrant comprised of an infiltrant material having a relatively low melting point to produce a composite molded part. In a preferred embodiment the skeleton material is $TiB_2$ and the infiltrant material is aluminum and the composite binder is comprised of a plastic and a wax. In this embodiment the wax portion of the composite binder is removed using a solvent and the plastic is removed during the infiltration step. The resulting composite part has a $TiB_2$ skeleton with voids substantially filled with aluminum. This process is especially useful for making light and strong parts with complex shapes such as golf club heads, tools, cutting implements, thermal management products, rocket motor components and bicycle parts. In another preferred embodiment, a golf club head is comprised of three parts: an non-sintered $TiB_2$ part for the body of the head, a sintered $TiB_2$ part for the striking surface of the head, and a heavy tungsten part to provide weight for the head. In this embodiment, the aluminum infiltrant substantially fills the voids in all three parts to create a golf club head with optimum characteristics.

3 Claims, 3 Drawing Sheets

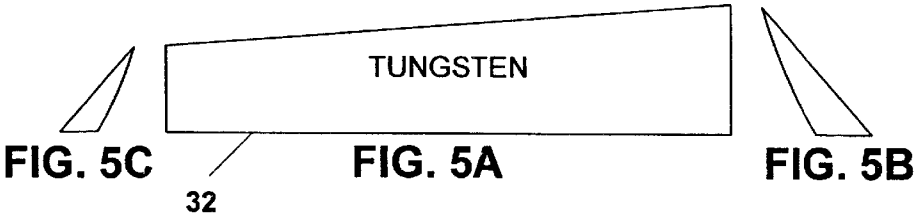
FIG. 5A
FIG. 5B
FIG. 5C
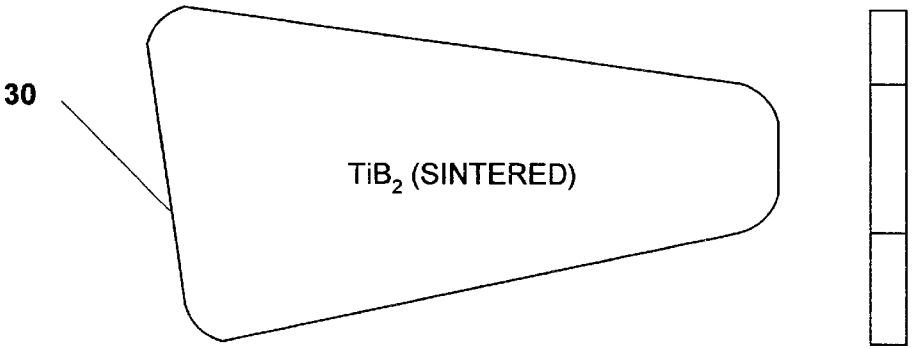
FIG. 4A
FIG. 4B
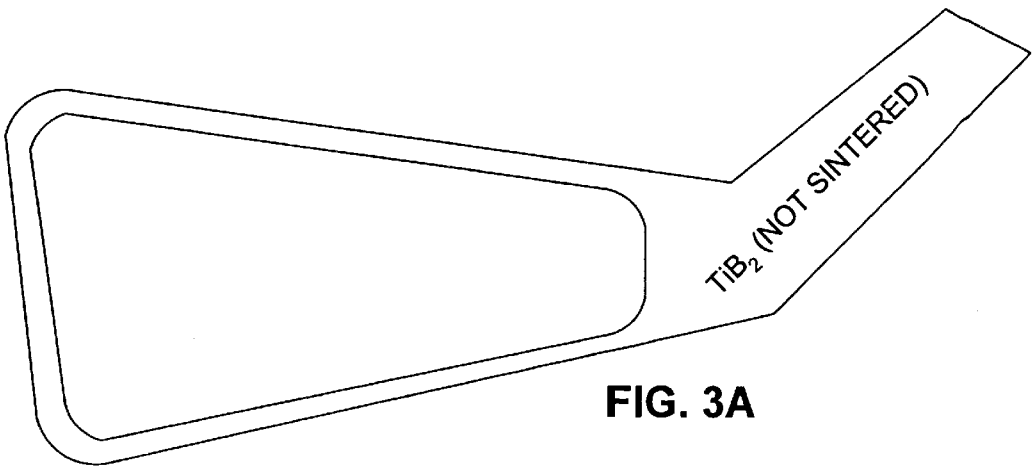
FIG. 3A
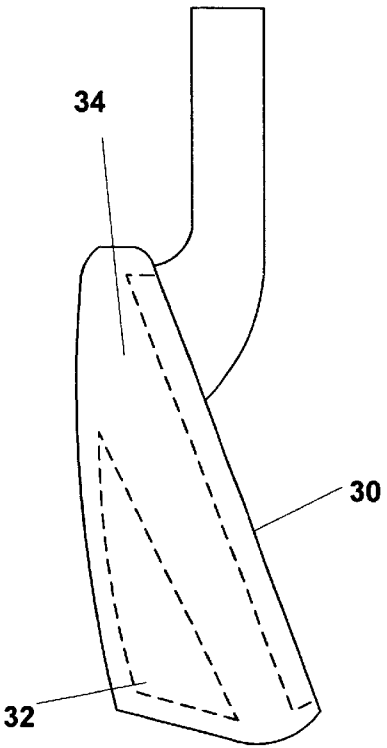
FIG. 3B

POWDER INJECTION MOLDING AND INFILTRATION PROCESS

The present invention relates to molding processes and in particular to powder injection molding and infiltration processes. This is a continuation-in-part application of Ser. No. 09/044,070 filed Mar. 16, 1998 now abandoned.

BACKGROUND OF THE INVENTION

Powder Metallurgy

Powder metallurgy is a well-known technology. Crude forms of this technology were practiced in ancient Egypt as early as 3000 BC. This prior art process normally consists of four basic steps:

1. Producing a fine powder.
2. Mixing the powder and preparing the mixture for use.
3. Pressing the mixture into a desired shape.
4. Heating (sintering) the shape at a desired temperature.

The pressing and sintering operations of powder metallurgy are of special importance. The pressing and repressing greatly affect the density of the product, which has a direct relationship to the strength properties. Sintering promotes bonding of the powder particles, with densification resulting in a single piece of material with good mechanical properties. Sintering of metals and some compounds usually is done in a controlled, inert or reducing atmosphere, while oxide ceramics are sintered in air. Many products having complex shapes can be produced at relatively low cost because subsequent machining steps are either minimal or are eliminated all together.

Infiltration

It is known that placing products made using powder metallurgy processes in a bath of certain molten metals and allowing the molten metal to infiltrate into the voids of the product may produce composite products. A good discussion of this process of infiltration of a solid-phase powder compact with liquid metals is contained in an article entitled-"Infiltration" by Claus G. Goetzel which is contained in the Powder metallurgy Volume of the Metals Handbook published by ASM International which article is incorporated herein by reference. The powder skeleton material must have a melting point substantially higher than the melting point of the infiltrant. This article in Table I lists 135 possible composites by making a matrix table of 25 skeleton materials (such as aluminum, chromium, copper, iron, molybdenum, nickel, silver, titanium carbide, tungsten and tungsten carbide) and 19 infiltrants (such as bismuth, cobalt, copper, lead, mercury, nickel, silver and tin). Only 22 of these possible combinations were reported as being commercially significant. Such examples were copper skeleton infiltrated with bismuth, lead or tin, and a tungsten skeleton infiltrated with copper, lead, nickel or silver. Sintering usually causes the molded product to shrink. The shrinkage is predicable and is allowed for in the pressing die.

Injection Molding

Injection molding techniques are well known. Plastic material in the form of powder, pellets or grains is placed in a hopper above a heated cylinder called the barrel. From the hopper, an appropriate amount of material is metered into the barrel every cycle. The plastic material, under pressures up to about 36,000 psi, is forced into a closed mold. The mold cools for a few seconds and is then opened and the molded parts are ejected.

Complex Shapes

Many products such as golf club heads have complex shapes and there is a need to permit a golf club designer to be able to specify various weight distributions within the part and to specify variations in other properties such as hardness, elasticity and strength at various locations within the part. In U.S. Pat. No. 4,768,787, Shira discloses a metallic surface layer containing hard particles on a golf club face in order to improve friction between the ball and the club.

The Need

A need exists for an improved powder injection molding and infiltration process which can further reduce the costs of producing complex shaped products and permit the cost effective commercial production of products having desired shapes, strengths, color and weights or to permit cost effective production of parts having desired weight distributions.

SUMMARY OF THE INVENTION

The present invention provides a powder injection molding and infiltration process. A powder for a skeleton material having a relatively high melting point is mixed with a composite binder to form a molding mixture. The composite binder is comprised of at least two different binder materials. The molding mixture is molded into a desired shape in a mold device to produce a molded part. The composite binder is then removed to produce voids in the molded part and the voids are filled by infiltrating an infiltrant comprised of an infiltrant material having a relatively low melting point to produce a composite molded part.

In a preferred embodiment the skeleton material is $TiB_2$ and the infiltrant material is aluminum and the composite binder is comprised of a plastic and a wax. In this embodiment the wax portion of the composite binder is removed using a solvent and the plastic is removed during the infiltration step. The resulting composite part has a $TiB_2$ skeleton with voids substantially filled with aluminum. This process is especially useful for making light and strong parts with complex shapes such as golf club heads, bicycle parts, cutting tools and wear resistant applications. The process can be automated to very efficiently produce high quality parts having complex shapes with physical properties characteristic of the properties of both the skeleton material and the infiltrant material.

In another preferred embodiment where the process is used to make a golf club head, the golf club head is comprised of three parts: a non-sintered $TiB_2$ part for the body of the head, a sintered $TiB_2$ part for the striking surface of the head, and a heavy tungsten part to provide weight for the head. In this embodiment, the aluminum infiltrant serves to substantially fill the voids in all three parts and to join the three parts to create a composite golf club head.

BRIEF DESCRIPTION OF THE DRAWINGS

FIG. 3A shows a front view of the striking surface of a golf club head.

FIG. 3B shows a side view of the golf club head.

FIG. 4A shows a front view of the sintered part of the golf club head.

FIG. 4B shows a side view of the sintered part of the golf club head.

FIG. 5A shows a front view of the tungsten part.

FIGS. 5B–5C show side views of the tungsten part.

DETAILED DESCRIPTION OF THE PREFERRED EMBODIMENTS

First Preferred Embodiment—Minimal Sintering

Figure 1:
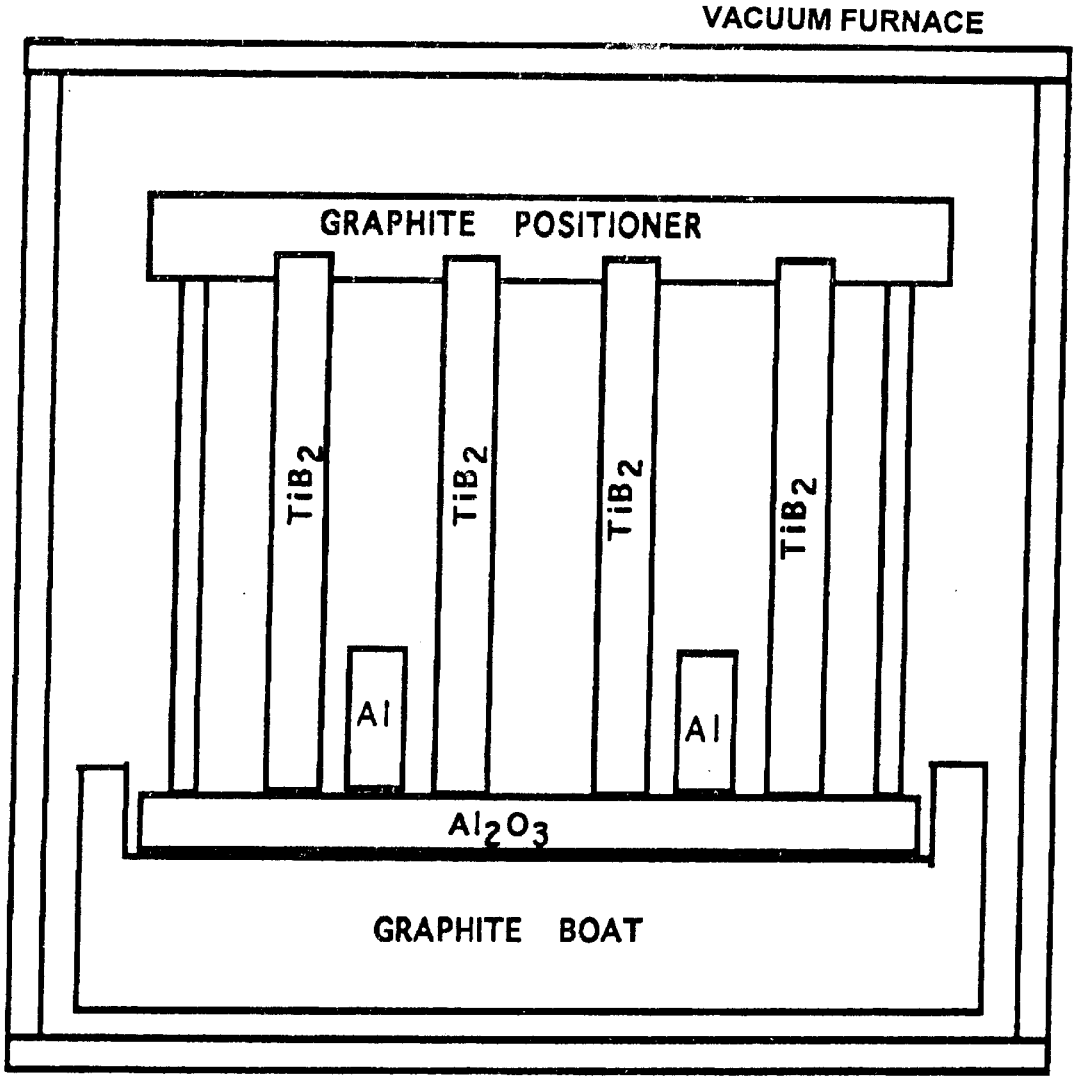
FIG. 1 shows four molded parts in a vacuum furnace.

A first preferred embodiment of the present invention is described below for the fabrication of golf club heads.

Feedstock

The feedstock that will eventually be molded into a desired shape of a golf club head, is a mixture of approximately 80 wt. % $TiB_2$ powder and 20 wt. % binder. The binder is composed of both waxes and plastic. Because the amount of binder determines the amount of infiltrant in the desired part, the amount of binder can be adjusted up or down to fine-tune the properties of the desired part. In the preferred embodiment, the $TiB_2$ powder is grade E available from H.C. Stark, with offices in Germany. It has an average particle size of $D_{50}$=4.4 microns. The binder has the following properties:

| | |
|---|---|
| Polypropylene | 38.0 wt. % |
| Paraffin wax | 49.0 wt. % |
| Carnauba wax | 10.0 wt. % |
| Stearic acid | 3.0 wt. % |
| TOTAL | 100. wt. % |

A mix of 1,400 grams of feedstock is made in a double walled, oil heated mixer chamber with two sigma blades and a close fitting lid. Capacity of the mixer chamber is 1 quart. First, the mixer chamber is heated to 160–170 degrees Centigrade. Then 280 grams of binder is added to the mixer chamber and melted while the sigma blades are turning and mixing. Approximately five minutes later, 1,120 grams of $TiB_2$ powder is slowly added to the mixer chamber with the blades still turning. After the $TiB_2$ powder is added and a smooth consistency is observed the lid of the mixing chamber is attached and the feedstock is allowed to continue to mix for 1 hour with the temperature maintained at 160 degrees Centigrade.

After the one hour of mixing, the feedstock should be very smooth, indicating thorough mixing. Then the mix is removed from the mixer with a spoon and spatula and the small lumps of mix are placed in a stainless steel tray to cool. When the mix lumps have cooled to room temperature they are granulated in a granulator of the type typically used for regrinding plastic sprues and runners. The granules are approximately 0.20 in. in diameter or smaller as necessary for feedstock to flow into the injection-molding machine.

Molds for Golf Club Inserts

Two different molds were used to make inserts for a golf club head. The molded parts weighed 30.2 and 15.9 grams and had a thickness' of 0.182 and 0.084 inches, respectively. Both measured approximately 2.5 inches on the longest edge.

The molding machine used was an Arburg 270C Allrounder 500–100, made by Arburg with offices in Germany. The screw diameter was 20 millimeters. The barrel temperature was 120 degrees Centigrade at the feed end and increased progressively to 160 degrees Centigrade at the nozzle. Injection pressure was 905 bar (13,303 psi). Injection speed was 60 cubic centimeters per second. The shot to shot cycle was 43 seconds including a cooling period of 20 seconds. Mold heaters were not used in these runs.

Removing the Wax Components of the Binder

The wax components of the binder were removed by placing the molded inserts in a tank filled with a solvent for waxes, 1, 1, 1 trichloroethane for 36 hours at room temperature. The wax removal was confirmed by weighing the parts before immersion and after immersion in the solvent The dewaxed parts were thoroughly dried in an oven at 65 degrees Centigrade to remove residual solvent before weighing. The polypropylene backbone binder was left in the molded inserts. This fact was evident because the weight loss corresponded exactly to the weight of the waxes and the molded inserts successfully maintained their shape.

Infiltration of Aluminum into the Molding

Infiltration of Aluminum into the molded and dewaxed parts was accomplished in a vacuum furnace using a graphite crucible lined with 0.015-in. thick graphoil and fitted with a screw on lid. A graphite boat was positioned inside the crucible to contain the molten aluminum. An alumina wafer was placed in the bottom of the graphite boat. The molded and dewaxed part was placed on the alumina wafer. The weight of aluminum used was double the pail weight to en sure excess to cover any losses to the furnace * atmosphere or to the bottom of the crucible. The aluminum metal to be infiltrated was placed adjacent to the part so that when it melted it could contact the part. The aluminum was not placed on the part in order to keep the top surface of the part free from any excess aluminum. The lid was positioned securely on the crucible and the crucible was positioned in the vacuum furnace. The furnace was evacuated to 0.0005 ton or less and then heated at a rate not more than 10C/min. to 1,200C. The crucible was held at 1,200C for 30 minutes and then allowed to furnace cool to below 300 degrees Centigrade. At this point the crucible was removed from the furnace and the parts removed from the crucible. The parts had a tendency to be bonded with aluminum to the alumina wafer and had to be separated by cutting or grinding. It was obvious that the aluminum had infiltrated the parts to their tops even though the tops were positioned well above the molten aluminum. The strength of the resulting parts was tested and compared to the strength of wrought 7075 aluminum. The elastic modulus was increased between 50 percent and 100 percent as compared to wrought aluminum.

Second Preferred Embodiment—With Sintering

A second preferred embodiment of the present invention is described below for the fabrication of golf club heads. In this embodiment a sintering step is included. This somewhat complicates the process and allowance must be made in molding the part for the shrinkage due to the sintering step. However, sintering in this case greatly increases the strength of the part. The procedure to produce the part with sintering was as follows:

Molding

Follow the procedure described above.

Sintering

Sinter the part at temperatures up to about 1800 degrees C for about 10 minutes to about 2 hours. (Longer times and higher temperatures in this range will yield a harder/stronger part.) A preferred time and temperature is 30 minutes at 1800 degrees C.

Infiltration

Figure 2:
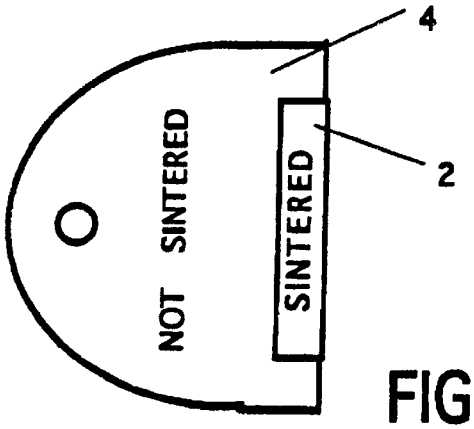
FIG. 2 shows a golf club head made in accordance with the present invention.

1. Line the inside of graphite crucible with 0.015-inch thick graphoil.
2. Position graphite boat inside crucible.
3. Place an alumina wafer in the bottom of the graphite boat.
4. Position the metal injection molded part inside the boat on top of the alumina wafer. Insure that the part has had the binder partially removed according to the procedure described above.
5. Weigh out aluminum metal in bar form to equal twice the mass of the part that is to be infiltrated. Position the aluminum metal adjacent to the part so that the part will contact the molten metal. If it is desirable to keep one surface of the part cosmetically untouched then the aluminum should not be allowed to touch this surface.
6. Position the lid securely on the graphite crucible.
7. Position the loaded crucible inside the vacuum furnace and evacuate chamber.
8. Once the vacuum in the furnace is below $5\times10^{-4}$ torr then begin heating the furnace to 1,200 degrees C at a rate of no more than 10 degrees per minute.
9. Hold the crucible at 1,200 degrees for 30 minutes.
10. Furnace cool the crucible to below 300 degrees C.
11. Remove the crucible and remove the part from the crucible.
12. The part may be bonded to the graphite boat and /or the alumina wafer. Remove excess material by cutting or grinding Third Preferred Embodiment This third preferred embodiment is also a process for making a golf club head. A top view sketch of a completed driver head is shown in FIG. 2. The head consists of two parts, a sintered part 2 and an non-sintered part 4. The sintered part is made using the second preferred embodiment. The completed head is then made using the first preferred embodiment except that the sintered part is placed in the mold cavity of the mold machine and the rest of the driver head is molded around it. Sintering of part 2 makes it substantially harder than the rest of the driver head.

Fourth Preferred Embodiment

A fourth preferred embodiment is illustrated in FIGS. 3A–6. In this embodiment, the head consists of three parts: a sintered $TiB_2$ part 30, a non-sintered $TiB_2$ part 34, and a non-sintered tungsten heavy alloy part 32. Sintered $TiB_2$ part 30 is first made using the procedures outlined for the second preferred embodiment. Then, non-sintered tungsten part 32 is made utilizing the procedures outlined for the first preferred embodiment, except that instead of having a mixture that is 80 wt. % TiB2 powder and 20 wt. % binder, the mixture is 95 wt. % tungsten powder and 5 wt. % binder.

After sintered $TiB_2$ part 30 and non-sintered tungsten part 32 are made, the completed head is made using the method of the first preferred embodiment, except that sintered part 30 and tungsten part 32 are placed in the mold cavity of the mold machine and the rest of the driver head is molded around it.

Fifth Preferred Embodiment

A fifth preferred embodiment is illustrated in FIGS. 3A–6. As in the fourth preferred embodiment, the head consists of three parts: a sintered $TiB_2$ part 30, a non-sintered $TiB_2$ part 34, and a sintered tungsten heavy alloy part 32. Sintered $TiB_2$ part 30 is first made using the procedures outlined for the second preferred embodiment. Then, sintered tungsten heavy alloy part 32 is made utilizing the procedures for sintered $TiB_2$ part 30, except that the preferred sintering temperature is up to approximately 1,500 degrees C for a time period of approximately ten minutes to two hours.

After sintered $TiB_2$ part 30 and sintered tungsten heavy alloy part 32 are made, non-sintered $TiB_2$ part 34 is molded and prepared for infiltration according to the first embodiment. At this stage, parts 30, 32 and 34 are assembled into the desired component mold cavity. Preferably, the three parts are tightly clamped together. Then, all are infiltrated simultaneously according to the first embodiment.

Figure 6:
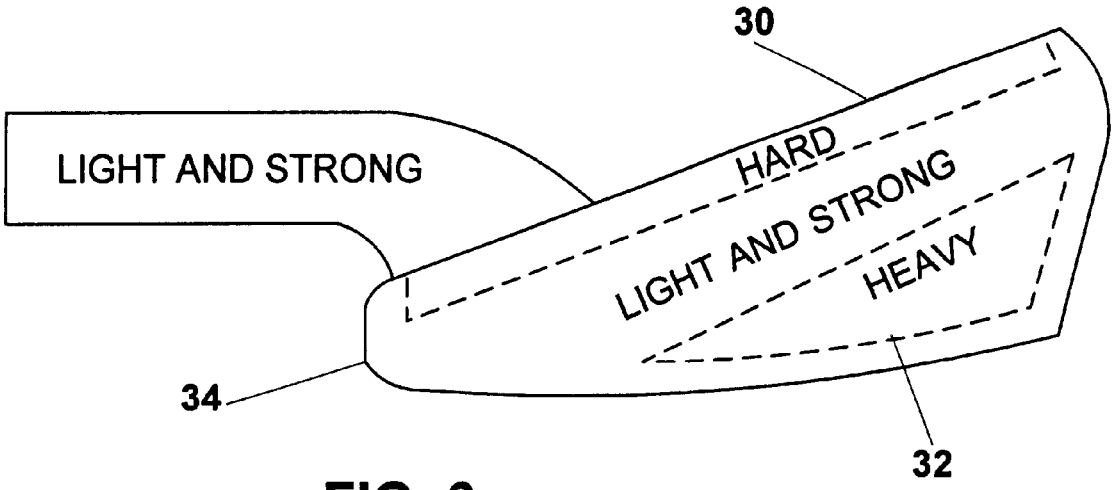
FIG. 6 shows the characteristics of a golf club head made by using a preferred embodiment of the present invention.

FIG. 6 illustrates some of the advantages of the fourth and fifth preferred embodiment. Sintered part 30 is hard, which provides for minimal deformation of the striking surface of the head when it impacts the golf ball. Non-sintered part 34 is light and strong, which makes the golf club easier to swing and gives the head some resiliency to avoid fracture. Tungsten part 30 is heavy, which helps increase momentum, therefore imparting greater power to the swing and controls the center of gravity according to the club design.

Although the above-preferred embodiments have been described with specificity, persons skilled in this art will recognize that many changes to the specific procedures disclosed above could be made without departing from the spirit of the invention. For example, in the fifth preferred embodiment, it was stated that prior to infiltrating the three parts, they should preferably be clamped together. There are other ways to hold the three parts together besides clamping. Other possibilities include a dovetail and pin arrangement, a mechanical clasp, or even the weight of the parts could cause them to press against one another through gravitational means. Other modifications are also possible. Many other skeleton material—infiltrant material combinations could be used. These include all of those disclosed in the Goetzel reference discussed in the Background section. The wax can be removed by slowly heating the molded part as an alternative to using the solvent. An extrusion machine could be used to make the part. The binder removal and infiltration step could be as described above. Tungsten or depleted uranium may be used for extra weight. Both would preferably be skeleton materials. UH, $UB_2$ and UC powders would be good. Other preferred skeleton materials include: $AlB_2$, $AlB_{12}$, $SiB_6$, B, $ZrB_2$, $HfB_2$, $VB_2$, $NbB_2$, $TaB_2$, $VB_2$, and carbides of V, Si, Ti, Zr, Hf, Nb, B, Ta, and Fe. Also, in some applications only a small portion of the molded part (such as the runner or the runner and the sprue) would be submerged in the melted infiltrant. The infiltrant would then be drawn into the rest of the part through the submerged part. Therefore, the scope of the invention is to be determined by the appended claims and their legal equivalents.

We claim:

1. A powder injection and infiltration process comprising the steps of:

A) making a sintered pail comprising interconnected voids, the steps for making said sintered part comprising:

i) mixing powder of a first skeleton material with a composite binder comprised of at least two binder materials to form a first mold mixture, ii) molding the mold mixture into a desired shape in a mold device to produce a first molded part, iii) sintering the first molded part to produce said sintered part, and iv) removing the composite binder to produce interconnected voids in said sintered part, B) making a heavy part comprising interconnected voids, the steps for making said heavy part comprising:

i) mixing powder of a second skeleton material with a composite binder comprised of at least two binder materials to form a second mold mixture, wherein said second skeleton material is heavier in relation to said first skeleton material, ii) molding the mold mixture into a desired shape in a mold device to produce said heavy part, and iii) removing the composite binder to produce interconnected voids in said heavy part, C) inserting said sintered part and said heavy part into a mold cavity, and D) molding around said sintered part and said heavy part, said steps for said molding comprising:

i) mixing powder of a third skeleton material with a composite binder comprised of at least two binder materials to form third mold mixture, wherein said second skeleton material is heavier in relation to said third skeleton material, ii) molding said third mold mixture into a desired shape by inserting said third mold mixture into a mold device comprising said mold cavity to produce a final molded part comprising said third mold mixture, said sintered part and said heavy part, iii) removing the composite binder in said third mold mixture to produce interconnected voids in said third mold mixture, and iv) at least substantially filling the interconnected voids in said final molded part with an infiltrant comprised of an infiltrant material having a relatively low melting point to produce a composite molded part.

2. A powder injection and infiltration process comprising the steps of:

A) making a sintered part comprising interconnected voids, the steps for making said sintered part comprising:

i) mixing powder of a first skeleton material with a composite binder comprised of at least two binder materials to form a first mold mixture, ii) molding the mold mixture into a desired shape in a mold device to produce a first molded part, iii) sintering the first molded part to produce said sintered part, and iv) removing the composite binder to produce interconnected voids in said sintered part, B) making a sintered heavy part comprising interconnected voids, the steps for making said heavy part comprising:

i) mixing powder of a second skeleton material with a composite binder comprised of at least two binder materials to form a second mold mixture, wherein said second skeleton material is heavier in relation to said first skeleton material, ii) molding the mold mixture into a desired shape in a mold device to produce a heavy part, iii) sintering said heavy part to produce said sintered heavy part, and iv) removing the composite binder to produce interconnected voids in said sintered heavy part, C) making a non-sintered third part comprising interconnected voids, the steps for making said non-sintered third part comprising:

i) mixing powder of a third skeleton material with a composite binder comprised of at least two binder materials to form a third mold mixture, ii) molding the mold mixture into a desired shape in a mold device to produce a non-sintered third part, iii) removing the composite binder to produce interconnected voids in said non-sintered third part, D) inserting said sintered part, said sintered heavy part and said non-sintered third part into a mold cavity, E) pressing said sintered part, said sintered heavy part and said non-sintered third part together inside said mold cavity, and F) at least substantially filling the interconnected voids in said final molded part with an infiltrant comprised of an infiltrant material having a relatively low melting point to produce a composite molded part.

3. A powder injection and infiltration process to produce a molded product containing a first sintered part and a heavy sintered part comprising the steps of:

A) making a first sintered part comprising interconnected voids, the steps for making said first sintered part comprising:

i) mixing powder of a first skeleton material with a composite binder comprised of at least two binder materials to form a first mold mixture, ii) molding the mold mixture into a desired shape in a mold device to produce a first molded part, iii) sintering the first molded part to produce said first sintered part, and iv) removing the composite binder to produce interconnected voids in said first sintered part, B) making a sintered heavy part comprising interconnected voids, the steps for making said heavy part comprising:

i) mixing powder of a second skeleton material with a composite binder comprised of at least two binder materials to form a second mold mixture, wherein said second skeleton material is heavier in relation to said first skeleton material, ii) molding the mold mixture into a desired shape in a mold device to produce a heavy part, iii) sintering said heavy part to produce said sintered heavy part, and iv) removing the composite binder to produce interconnected voids in said sintered heavy part, C) inserting said first sintered part and said sintered heavy part into a mold cavity, and D) molding around said first sintered part and said sintered heavy part, said steps for said molding comprising:

i) mixing powder of a third skeleton material with a composite binder comprised of at least two binder materials to form third mold mixture, wherein said second skeleton material is heavier in relation to said third skeleton material, ii) molding said third mold mixture into a desired shape by inserting said third mold mixture into a mold device comprising said mold cavity to produce a final molded part comprising said third mold mixture, said first sintered part and said sintered heavy part, iii) removing the composite binder in said third mold mixture to produce interconnected voids in said third mold mixture, and iv) at least substantially filling the interconnected voids in said final molded part with an infiltrant comprised of an infiltrant material having a relatively low melting point to produce a composite molded part.

* * * * *